US008370964B1

(12) United States Patent
Kaper

(10) Patent No.: US 8,370,964 B1
(45) Date of Patent: Feb. 12, 2013

(54) PROTECTIVE GARMENT AND ASSOCIATED ACCESSORIES

(75) Inventor: Terry J. Kaper, Delta, OH (US)

(73) Assignee: Bluewater Concept, LLC, Delta, OH (US)

( * ) Notice: Subject to any disclaimer, the term of this patent is extended or adjusted under 35 U.S.C. 154(b) by 461 days.

(21) Appl. No.: 12/317,142

(22) Filed: Dec. 19, 2008

(51) Int. Cl.
*A41D 3/06* (2006.01)
*A41D 13/04* (2006.01)

(52) U.S. Cl. ..... 2/46; 2/47; 2/69; 2/84; 2/87

(58) Field of Classification Search ..... 2/46, 47, 2/455, 456, 457, 78.2, 87, 114, 111, 84, 211, 2/213, 72, 408, 22, 61, 62, 48, 51, 52, 69, 2/69.5, 79, 82, 88, 110, 217, 223, 242, 1, 2/23, 89; 128/846, 853, 849, 856, 873, 882; 602/3, 61, 62, 63; 108/27, 28, 50.11, 50.12, 108/50.14
See application file for complete search history.

(56) References Cited

U.S. PATENT DOCUMENTS 275,014 A * 4/1883 Blamchard ..... 2/47
282,254 A * 7/1883 Baker ..... 2/47
318,038 A * 5/1885 Sawyer ..... 2/47
532,859 A * 1/1895 Bean ..... 2/47
1,197,240 A * 9/1916 Smith ..... 2/47
1,580,453 A * 4/1926 Stentiford ..... 36/2 R
1,620,743 A * 3/1927 Stuart ..... 36/2 R
1,758,740 A * 5/1930 Gale ..... 2/78.2
2,010,483 A * 8/1935 Goodman ..... 2/78.2
2,229,575 A * 1/1941 Kaplan ..... 36/8.1
2,304,177 A * 12/1942 Jones ..... 36/2 R
2,372,110 A * 3/1945 Noone ..... 2/84
2,404,225 A * 7/1946 Green ..... 250/516.1
2,757,384 A * 8/1956 Slater ..... 4/601
3,066,307 A 12/1961 Loewe
3,042,931 A * 7/1962 Sawyer ..... 2/88
3,311,924 A * 4/1967 Roark ..... 2/87
3,329,144 A * 7/1967 Liman ..... 602/3
3,693,189 A * 9/1972 Mundt ..... 2/47
3,741,203 A * 6/1973 Liman ..... 602/3
3,973,276 A * 8/1976 Moses ..... 2/215
4,110,845 A * 9/1978 Chellis ..... 36/2 R
4,152,782 A * 5/1979 Kincaid ..... 2/74
4,224,935 A * 9/1980 Metelnick ..... 602/3
4,964,176 A 10/1990 Previdi
5,174,305 A * 12/1992 Childs ..... 128/846
5,181,274 A * 1/1993 DeFiore ..... 2/46
5,575,006 A * 11/1996 Wolfe ..... 2/114
5,592,953 A * 1/1997 Delao ..... 128/882
5,926,845 A * 7/1999 Troyer ..... 2/93
6,374,415 B1 * 4/2002 Lenart ..... 2/114
7,174,570 B2 2/2007 Dabney et al.
D581,135 S * 11/2008 Peterson ..... D2/823

(Continued)

*Primary Examiner* — Amy Vanatta
(74) *Attorney, Agent, or Firm* — King & Partners, PLC

(57) ABSTRACT

A protective garment for use while cleansing at least a portion of a user's body including: a lower garment, wherein the lower garment is adapted to releasably shield at least a portion of at least one lower extremity of an associated user while exposing an associated user's anal region; wherein the lower garment comprises a flexible, substantially waterproof member which includes: an upper region, wherein the upper region comprises a lower garment securement member which enables substantially water-tight releasable securement of the lower garment to an associated user; and a lower region, wherein the lower region and the upper region are spaced apart from one another to define a lower garment length. The protective garment optionally includes an upper garment and/or a base member.

17 Claims, 9 Drawing Sheets

U.S. PATENT DOCUMENTS 7,509,689 B2 * 3/2009 Reardon et al. ..... 2/88
D626,722 S * 11/2010 Macke et al. ..... D2/728
7,926,120 B2 * 4/2011 Birmingham ..... 2/51
2007/0130668 A1 * 6/2007 Berman et al. ..... 2/114
2009/0145340 A1 * 6/2009 Parvizian ..... 108/137
2009/0255027 A1 * 10/2009 Laitmon ..... 2/22

* cited by examiner

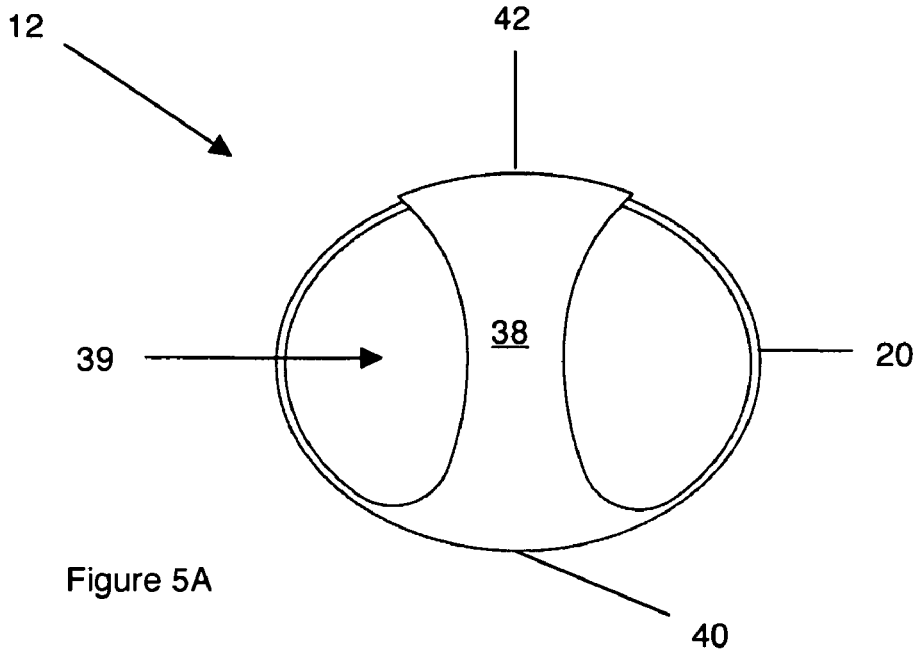
Figure 5A
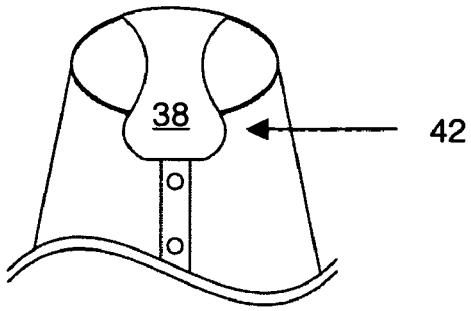
Figure 5B
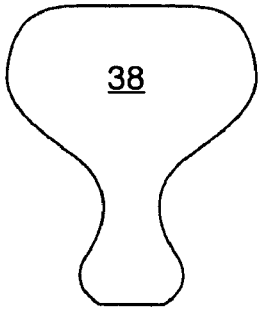
Figure 5C
Figures 5A-5C

PROTECTIVE GARMENT AND ASSOCIATED ACCESSORIES

CROSS-REFERENCE TO ASSOCIATED APPLICATION(S)

Not Applicable

BACKGROUND OF THE INVENTION

1. Field of the Invention

The present invention relates in general to a protective garment and, more particularly, to a protective garment and associated accessories which allow an individual user to cleanse select portions of his/her body while still fully and/or partially clothed.

2. Background Art

Protective garments have been known in the art for years. While such conventional garments have been known in the art for years, issues relative to allowing an individual to remain partially and/or fully clothed during a shower remain largely problematic. Typically, when an individual wishes to cleanse himself/herself in such a manner they must remove all clothing prior to washing. Under most circumstances this is not a cause for concern, but for some individuals with certain medical conditions that necessitate multiple cleansings of certain body parts a day, such as hemorrhoid sufferers, this continual undressing and redressing can be particularly inconvenient. In addition, a full shower and/or bath can be excessively time consuming and therefore be a further hindrance to the individual, especially when the process must be undertaken numerous times a day. While bidets and washlets can provide a solution to such problems, there are inherent issues involved with their use as well. Though effective in their own right, bidets and washlets are expensive, often necessitating investments of over a thousand dollars per unit, making it impractical for individuals to have more than one and therefore reducing the convenience of using multiple stations to suit their needs. Furthermore, even after such an investment, neither a bidet, nor a washlet provides the user with the flexibility/portability that many individuals require in their daily lives.

It is therefore an object of the present invention to provide a protective garment which allows an individual user to shower while remaining fully and/or partially clothed, and provides sufficient portability for personal convenience.

These and other objects of the present invention will become apparent in light of the present specifications, claims, and drawings.

SUMMARY OF THE INVENTION

The present invention is directed to a protective garment for use while cleansing at least a portion of a user's body, comprising: (a) a lower garment, wherein the lower garment is adapted to releasably shield at least a portion of at least one lower extremity of an associated user while exposing an associated user's anal region; and (b) wherein the lower garment comprises a flexible, substantially waterproof member which comprises: (1) an upper region, wherein the upper region comprises a lower garment securement member which enables substantially water-tight releasable securement of the lower garment to an associated user; and (2) a lower region, wherein the lower region and the upper region are spaced apart from one another to define a lower garment length.

In a preferred embodiment of the present invention, the lower region of the lower garment comprises a weighted hem.

In another preferred embodiment of the present invention, the lower garment securement member comprises a drawstring.

In yet another preferred embodiment of the present invention, the lower garment securement member comprises a loop of elastomeric material, which is secured about the upper region of the lower garment.

In another aspect of the present invention, the lower garment securement member further comprises: (a) a first strap, wherein the first strap comprises: (1) a first tab; and (2) a second tab; (b) a second strap, wherein the second strap comprises: (1) a first tab; and (2) a second tab; (c) wherein the first tab of the first strap and the first tab of the second strap are attached to at least a portion of the lower garment; (d) and wherein the second tab of the first strap comprises a series of hooks, and the second tab of the second strap comprises a series of loops; and (e) further wherein the second tab of the first strap and the second tab of the second strap cooperate and provide releasable securement of the lower garment to at least a portion of an associated individual.

In a preferred embodiment of the present invention, the lower garment further comprises a first end and a second end, wherein at least a portion of the first end comprises a series of loops and at least a portion of the second end comprises a series of hooks, and wherein the first end and the second end cooperate and provide releasable securement of the lower garment around at least a portion of an associated individual.

In another preferred embodiment of the present invention, the protective garment further comprises a splash guard. In this embodiment, the splash guard may comprise a sheet of flexible, substantially waterproof material, wherein the splash guard comprises a first end and a second end, and wherein the first end is fixedly attached to at least a portion of the lower garment and the second end is releasably associable with at least a portion of the lower garment.

In accordance with the present invention, the splash guard may also comprise a sheet of substantially waterproof material which is adapted to be positioned above the upper region of the lower garment and between the legs of an associated individual.

In a preferred embodiment of the present invention, the protective garment further comprises: (a) an upper garment, wherein the upper garment is adapted to releasably shield at least a portion of a torso of an associated user; (b) wherein the upper garment comprises a flexible, substantially waterproof member material which is adapted to cover at least a portion of a torso of an associated individual; and (c) a upper garment securement member which is associated with at least a portion of the upper garment.

In another preferred embodiment of the present invention, the upper garment further comprises a hood, wherein the hood is adapted to cover at least a portion of an associated individual's head.

In yet another preferred embodiment of the present invention, the upper garment further comprises a sleeve, wherein the sleeve is adapted to receive at least a portion of an arm of an associated individual therethrough.

In one embodiment of the present invention, the protective garment further comprises a base member, wherein the base member comprises: a bottom wall, a top wall, and at least one side wall which are spaced apart from one another to define a substantially polygonal area and/or cavity. In this embodiment the top wall further comprises a surface region at least partially fabricated from a non-slip material and/or the base member further comprises at least one ground engaging support member.

In a preferred embodiment of the present invention, the lower region of the lower garment extends below the top wall of the base member when the lower garment is associated with at least a portion of an individual.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein:

FIG. 5A of the drawings is a top plan view of a splash guard in conjunction with a lower garment in accordance with the present invention;

FIG. 5B of the drawings is a perspective view of a splash guard in conjunction with a lower garment in a secured arrangement in accordance with the present invention;

FIG. 5C of the drawings is a top plan view of a separate splash guard in accordance with the present invention;

DETAILED DESCRIPTION OF THE INVENTION

Figure 1:
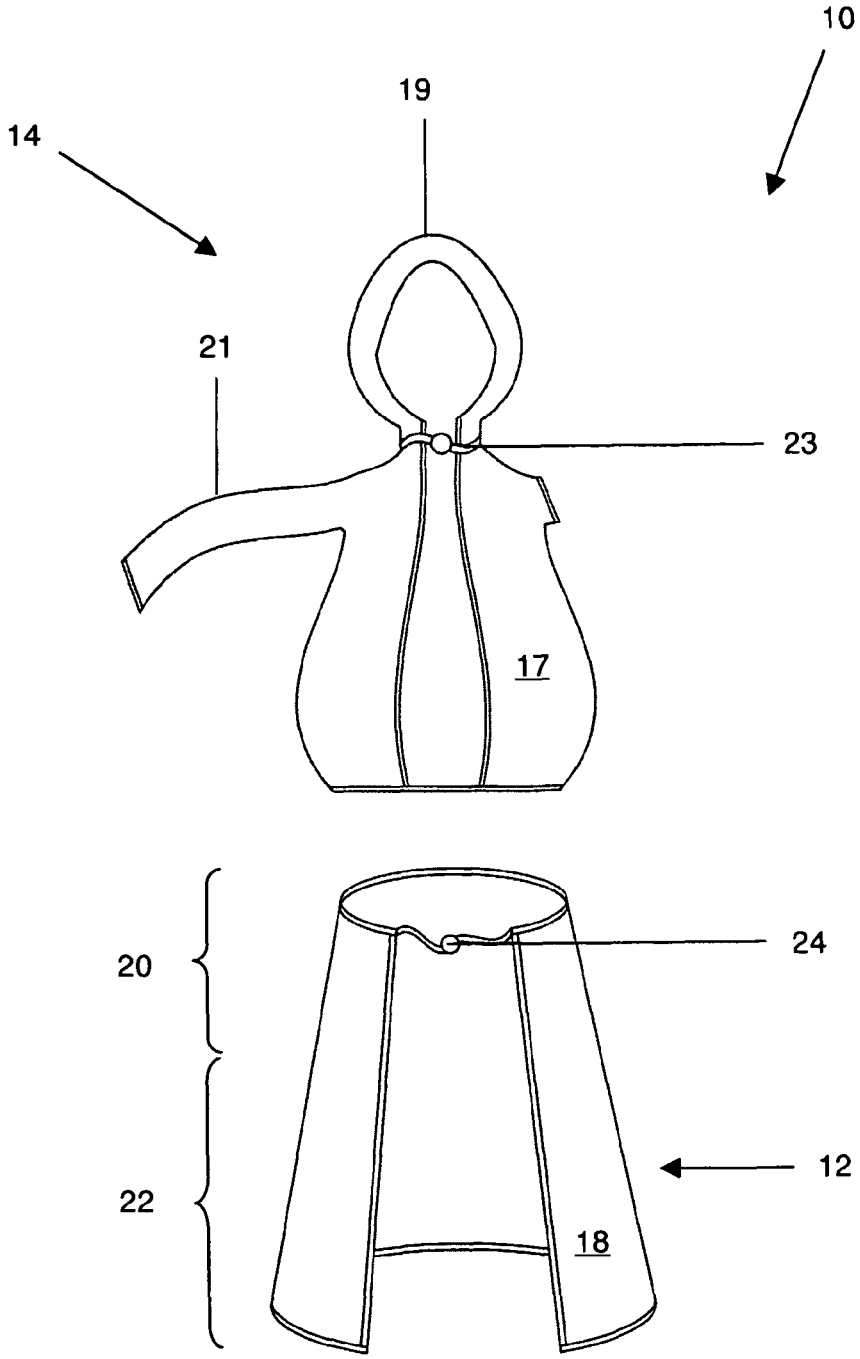
FIG. 1 of the drawings is a perspective view of a protective garment showing among other things, a lower garment and an optional upper garment fabricated in accordance with the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Figure 8:
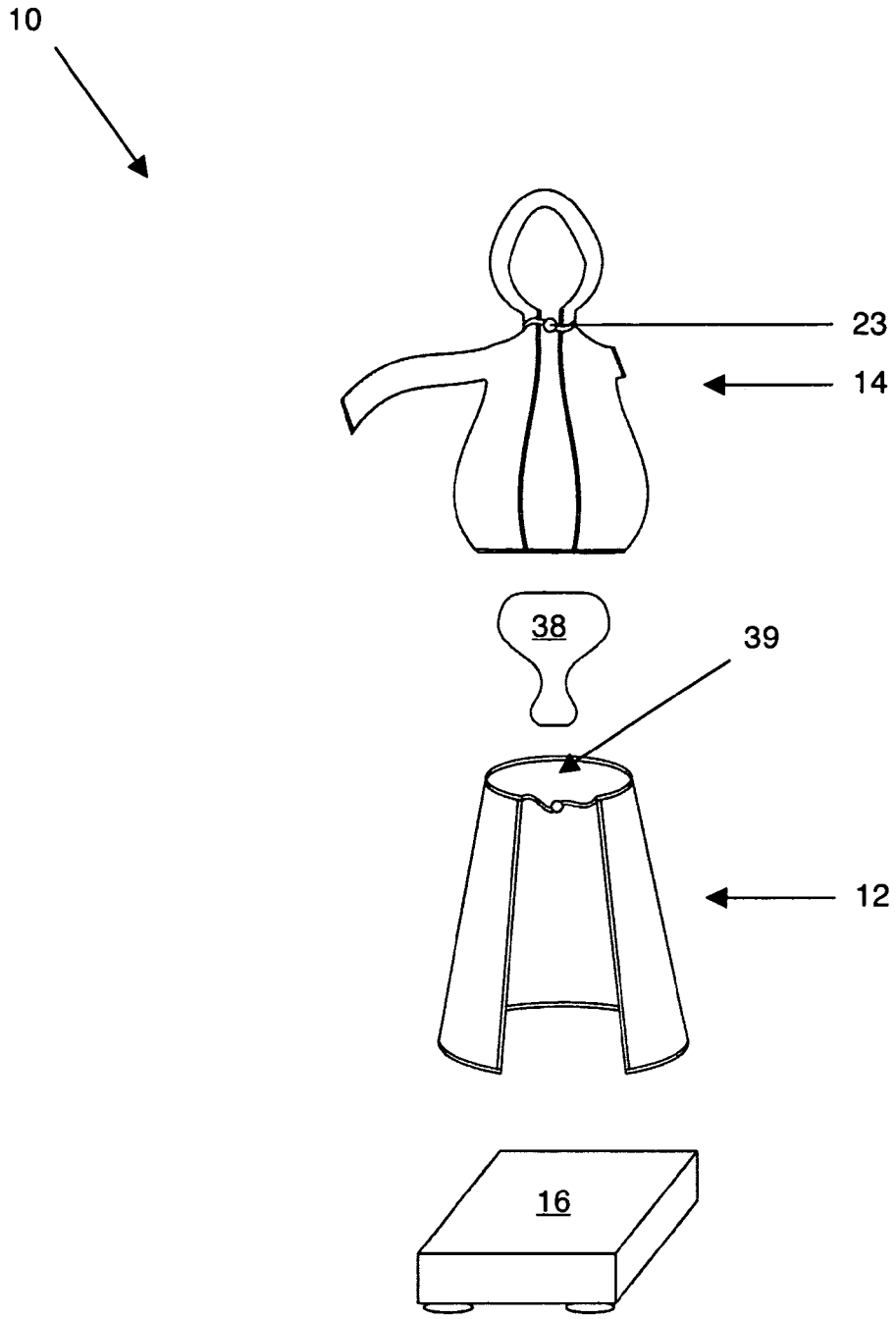
FIG. 8 of the drawings is an exploded perspective view of a protective garment assembly in accordance with the present invention.

Referring now to the drawings and to FIGS. 1 and 8, collectively, perspective representations of protective garments are shown which generally comprise lower garment 12, optional upper garment 14, and optional base member 16.

Referring singularly to FIG. 1, lower garment 12 of protective garment 10 is shown as generally comprising body 18, upper region 20, lower region 22 and lower garment securement member 24. As will be discussed in greater detail infra, similar to upper garment 14, all components of lower garment 12 are preferably fabricated from a flexible, natural and/or synthetic, substantially waterproof material or fabric—including, but not limited to, eVent by eVent Fabrics, Nikwax by Paramo Directional Clothing, Gore-Tex, Sympatex, 3-ply by Entrant-EVmembrane Mountain Equipment Co-op, AquaNix by Taiga Works, Entrant by Toray Industries, Drilite Extreme by Mountain Equipment, HyVent by Toray, H2No by Toray, Omni-Tech by Columbia Sportswear, Conduit by Mountain Hardwear, Triplepoint Ceramic by Lowe Alpine, Precip by Marmot, Watergate by Outdoor Designs, closely woven cotton, Polymer-encapsulated cotton EPIC made by Nextec, Wax impregnated cotton or cotton/polyester mixes, Neoprene, etcetera. It will be understood that while specific materials have been disclosed, any one of a number of materials that would be known to one of ordinary skill in the art with the present disclosure before them are likewise contemplated for use in accordance with the present invention.

Figure 2:
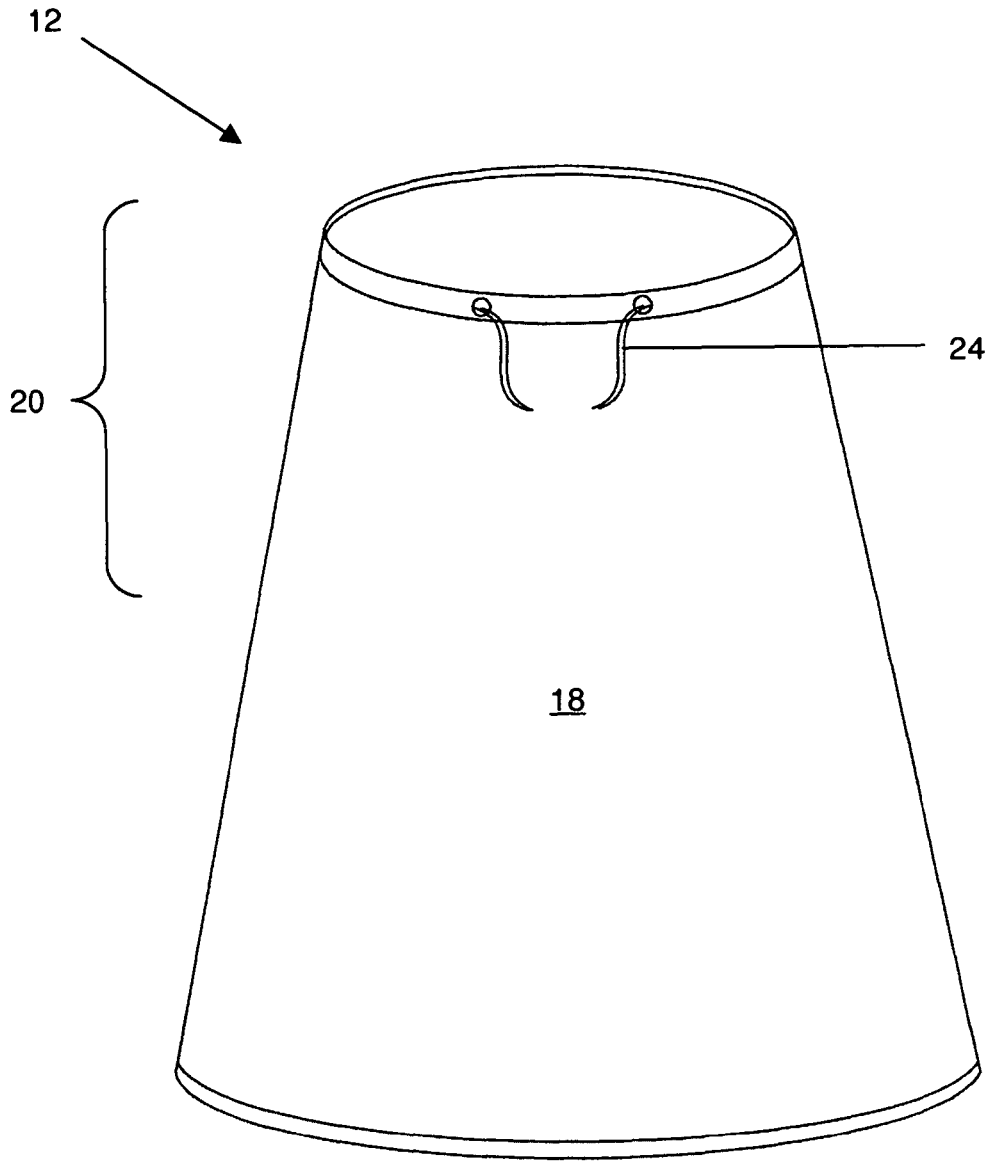
FIG. 2 of the drawings is a perspective view of a lower garment in accordance with the present invention.

Referring now to FIG. 2, a preferred embodiment of lower garment 12 is shown. In this embodiment, body 18 of lower garment 12 may preferably comprise a substantially cylindrical skirt of material. To preclude lower garment 12 from undesirable movement, lower garment 12 preferably further comprises lower garment securement member 24. Lower garment securement member 24 is shown as comprising a drawstring fabricated into upper region 20. This drawstring may preferably be loosened to allow for the individual to put on the lower garment, and then preferably cinched tight to secure the lower garment around at least a portion of the individual so as to at least substantially preclude movement of lower garment 12 about an individual, as well as preclude water from reaching a user's pants, shorts, etcetera.

Figure 3:
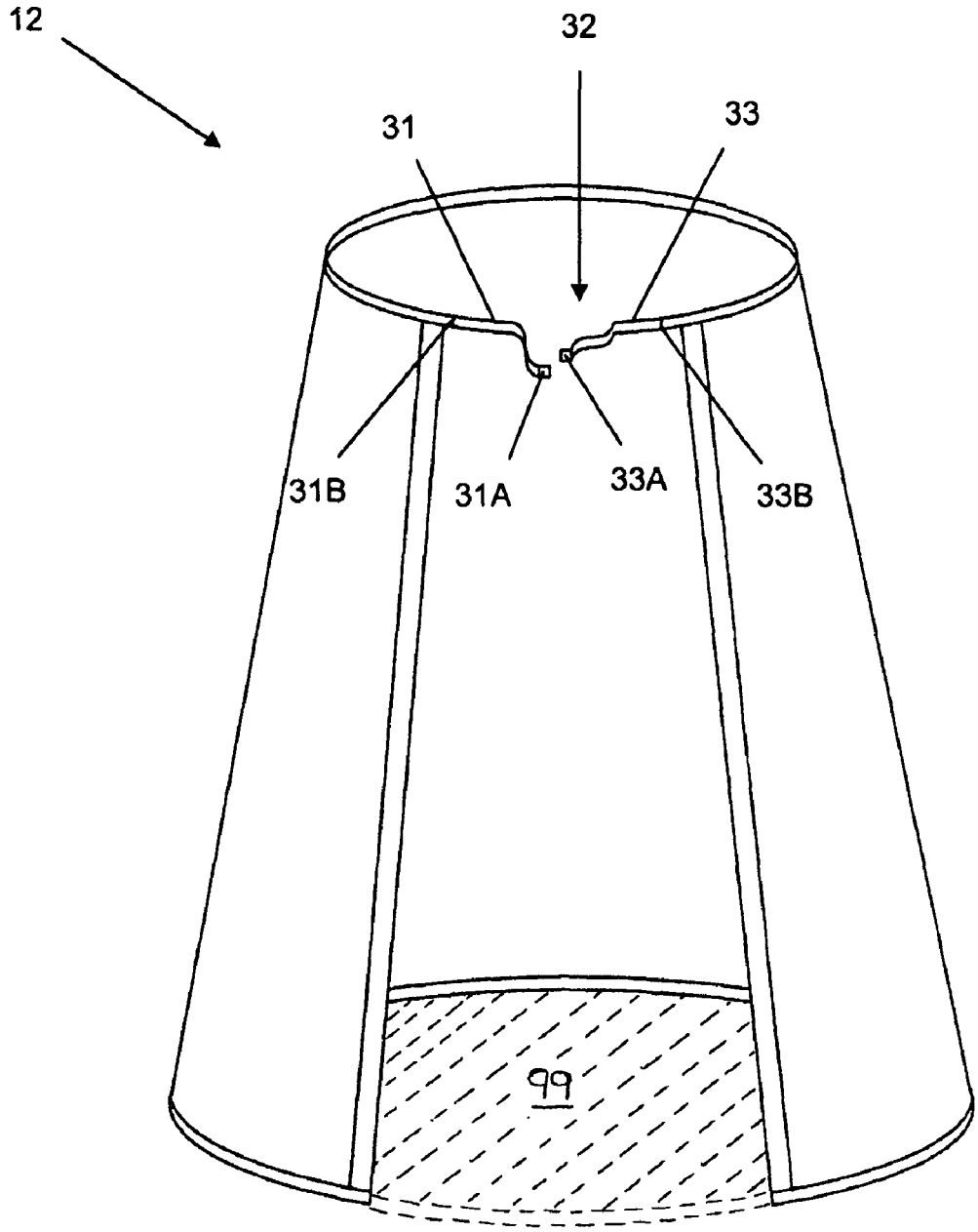
FIGS. 3-4 of the drawings are perspective views of alternative embodiments of lower garments in accordance with the present invention.

Referring now to FIG. 3, an alternative embodiment of lower garment 12 is shown. In this embodiment, lower garment securement member 24 preferably comprises a pair of straps with securement regions. First strap 31 preferably comprises first tab 31A and second tab 31B. Likewise, second strap 33 preferably comprises first tab 33A and second tab 33B. First tab 31A of the first strap 31 and first tab 33A of second strap 33 are attached to at least a portion of lower garment 14. Also, second tab 31B of first strap 31 may comprise a series of hooks, and second tab 33B of the second strap 33 comprises a series of loops. In operation, second tab 31B of first strap 31 and second tab 33B of second strap 33 cooperate to provide releasable securement of lower garment 14 to at least a portion of an individual. Though this embodiment discloses hook and loop fasteners, any suitable releasable attachment means may be used, including but not limited to, a snapping type fastener, a button and loop, or a zipper—just to name a few. It will be understood that, in all embodiments herein, lower garment 12 may optionally comprise base member 99 which facilitates closure of the same.

Figure 4:
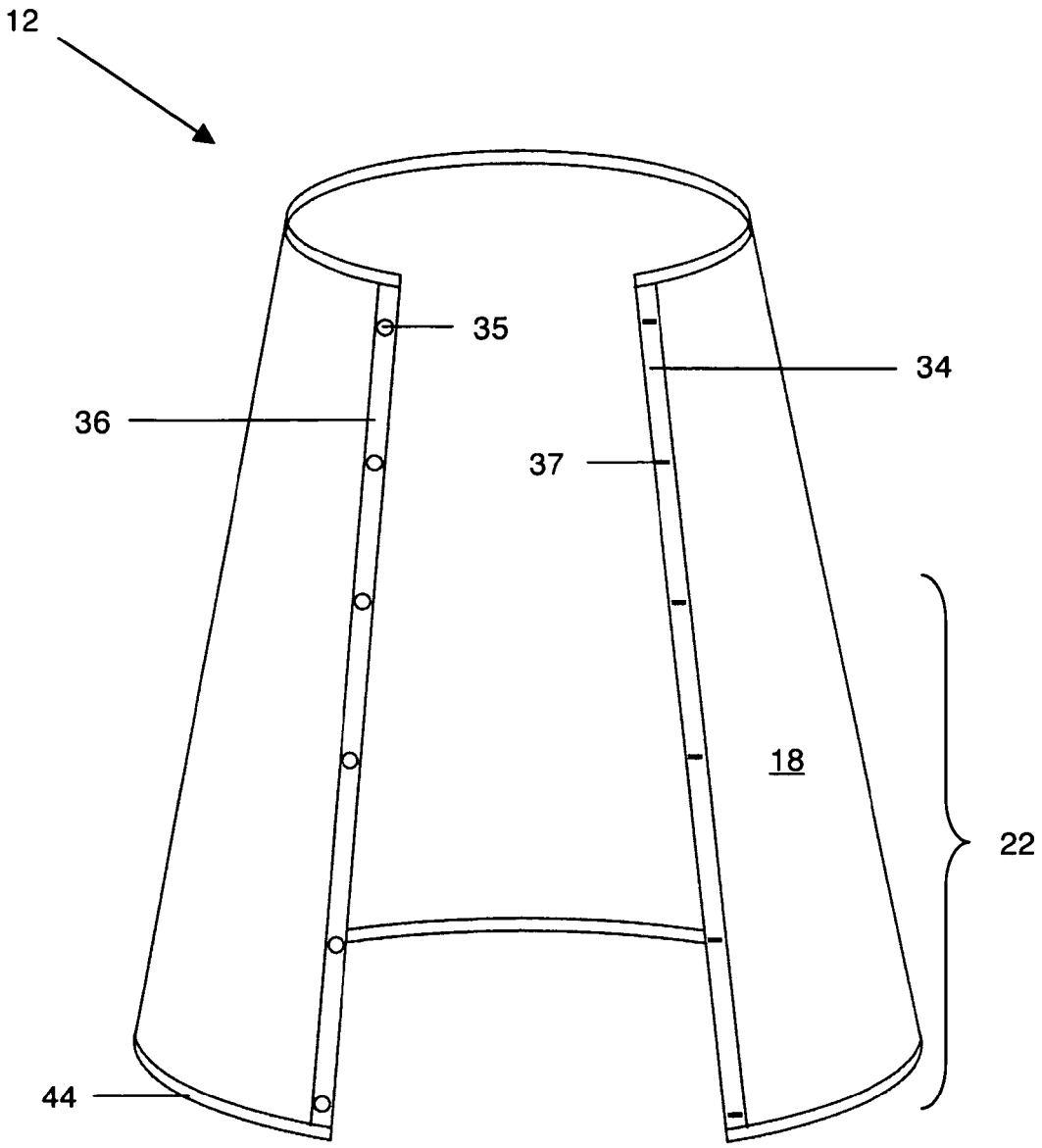

Referring now to FIG. 4, an alternative embodiment of lower garment 12 is shown. In this preferred embodiment, body 18 of lower garment 12 may preferably comprise a sheet of material having first end 34 and second end 36. Apertures 37 are fabricated into first end 34 of lower garment 12. These apertures receive buttons 35, which cooperate with the apertures to secure lower garment 14 around at least a portion of an individual.

In accordance with the present invention, lower garment 12 may preferably further comprise weighted hem 44. Weighted hem 44 operates to keep lower garment 12 taut and/or straight, such that lower garment 12 is substantially precluded from undesirable movement. Weighted hem 44 is shown as associated with lower region 22, and in one embodiment preferably comprises a pocket that traverses the circumference of lower region 22 of lower garment 14 which contains a material such as, for example, sand and/or polymer/resin pellets, although any one of a number of weighted materials that would be known to one of ordinary skill in the art with the present disclosure before them are likewise contemplated for use in accordance with the present invention. While only shown in FIG. 4, it will be understood that weighted hem 44 may be used in association with any one of the lower garments disclosed herein. It will be further understood that weighted hem 44 facilitates protection of, for example, a user's feet and/or footwear from cleansed material of a user.

Referring now to FIG. 5A, splash guard 38 is shown in association with lower garment 12. Splash guard 38 operates to substantially preclude water from coming into contact with an individual wearing lower garment 12 by substantially covering opening 39. Splash guard 38 is shown as comprising a strip of material fabricated into upper region 20 of lower garment 12. Furthermore, splash guard 38 is shown as fixedly attached to back 40 of upper region 20 and releaseably associable with front 42 of upper region 20 (FIG. 5B). This releasable association of splash guard 38 with front 42 may be effected using a variety of releasable fasteners, for example, a series of hook and loop fasteners, although any one of a number of fasteners that would be known to one of ordinary skill in the art with the present disclosure before them are likewise contemplated for use in accordance with the present invention.

Referring now to FIG. 5C, an alternative embodiment of splash guard 38 is shown. In this embodiment, splash guard 38 preferably comprises a sheet of rigid and/or semi rigid material which is preferably adapted to be placed above lower garment 12 (see FIG. 8) and between the legs of an associated individual. This placement of splash guard preferably substantially precludes water from entering opening 39 and coming into contact with an individual wearing lower garment 12.

As is best shown in FIG. 1, upper garment 14 preferably comprises body 17, optional hood 19, optional sleeve 21 and upper garment securement member 23. All components of upper garment 14 are preferably fabricated from a flexible, waterproof material, or fabric including those disclosed relative to lower garment 12.

Body 17 of upper garment 14 is preferably configured to substantially surround at least a portion of the torso of an associated individual. Hood 19 is shown as extending from body 17 and operates to keep an individual's hair dry and/or substantially preclude water from infiltrating the top of upper garment 14. Also preferably associated with body 17 is sleeve 21. Sleeve 21 is adapted to allow an individual to operate the faucet of a shower and/or bathtub and keep the individual dry. In accordance with the present invention, upper garment 14 also preferably comprises upper garment securement member 24. Upper garment securement member 24 preferably secures upper garment 14 to at least a portion of an individual.

Figure 6:
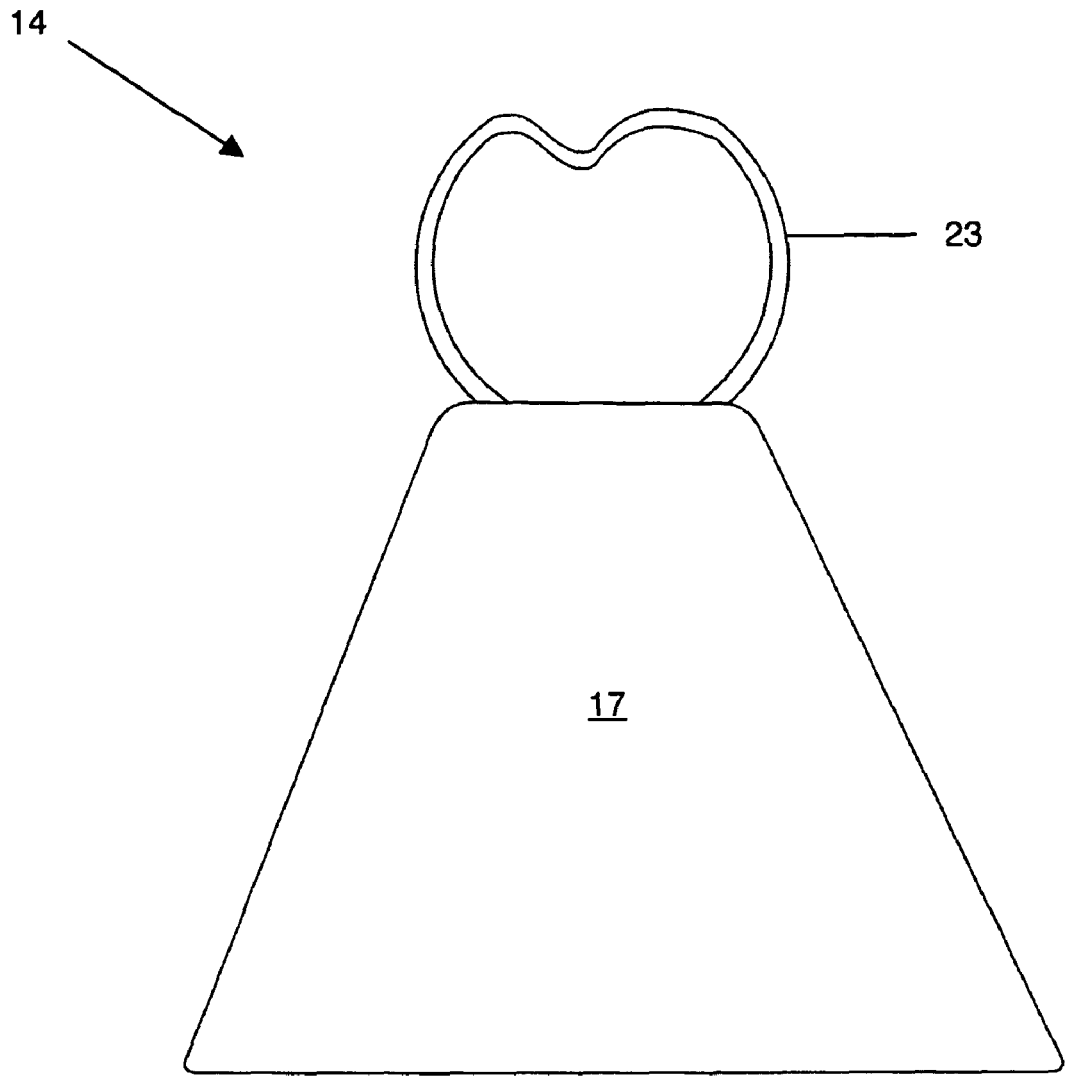
FIG. 6 of the drawings is a perspective view of an upper garment in accordance with the present invention.

Referring now to FIG. 6, an alternative embodiment of upper garment 14 is shown. In this preferred embodiment, body 17 of upper garment 14 may preferably comprise a simple sheet of flexible, waterproof material resembling an apron, having upper garment securement member 23 extending as a loop of material from body 17 of the sheet. This loop is configured to fit over an individual's head and around the individual's neck. This loop of material may comprise, for example, a strip of elastomeric material, or simply cloth, although any one of a number of materials that would be known to one of ordinary skill in the art with the present disclosure before them are likewise contemplated for use in accordance with the present invention.

Figure 7:
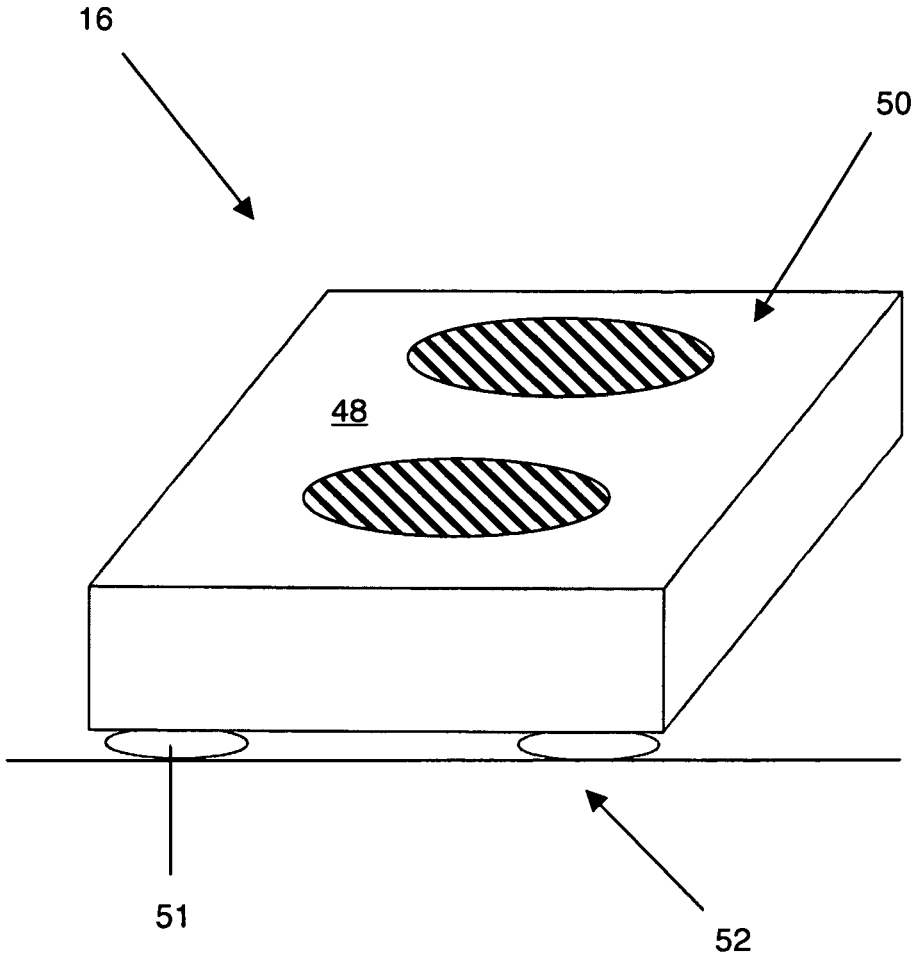
FIG. 7 of the drawings is a perspective view of a base member in accordance with the present invention.

Referring now to FIG. 7, protective garment 10 may also comprise an accessory base member 16. Base member 16 provides a stable platform for an individual to stand on. In one embodiment, base member 16 preferably comprises a first wall, a second wall, a third wall, and a fourth wall configured to create a substantially polygonal cavity. Furthermore, base member 16 preferably comprises top plate 48. Top plate 48 is shown as secured to the aforementioned walls. It will be understood that first wall, second wall, third wall, fourth wall, and top plate may preferably be fabricated as a unitary member. It will further be understood that top plate 48 may preferably comprise top surface 50, which itself comprises a layer and/or coating of non-slip material. To stabilize base member 16 during operation, base member 16 may preferably comprise a plurality of ground engaging support members 51. Ground engaging support members 51 are preferably attached to base member 16 and also preferably comprise a region of non-slip material fabricated onto the outer surfaces of ground engaging members 51. It will be understood that this non-slip material ensures that base 16 stays in contact with surface 52. It will be further understood that base member 16 facilitates keeping a user's feet and/or footwear clean from any cleansed material.

Figure 9:
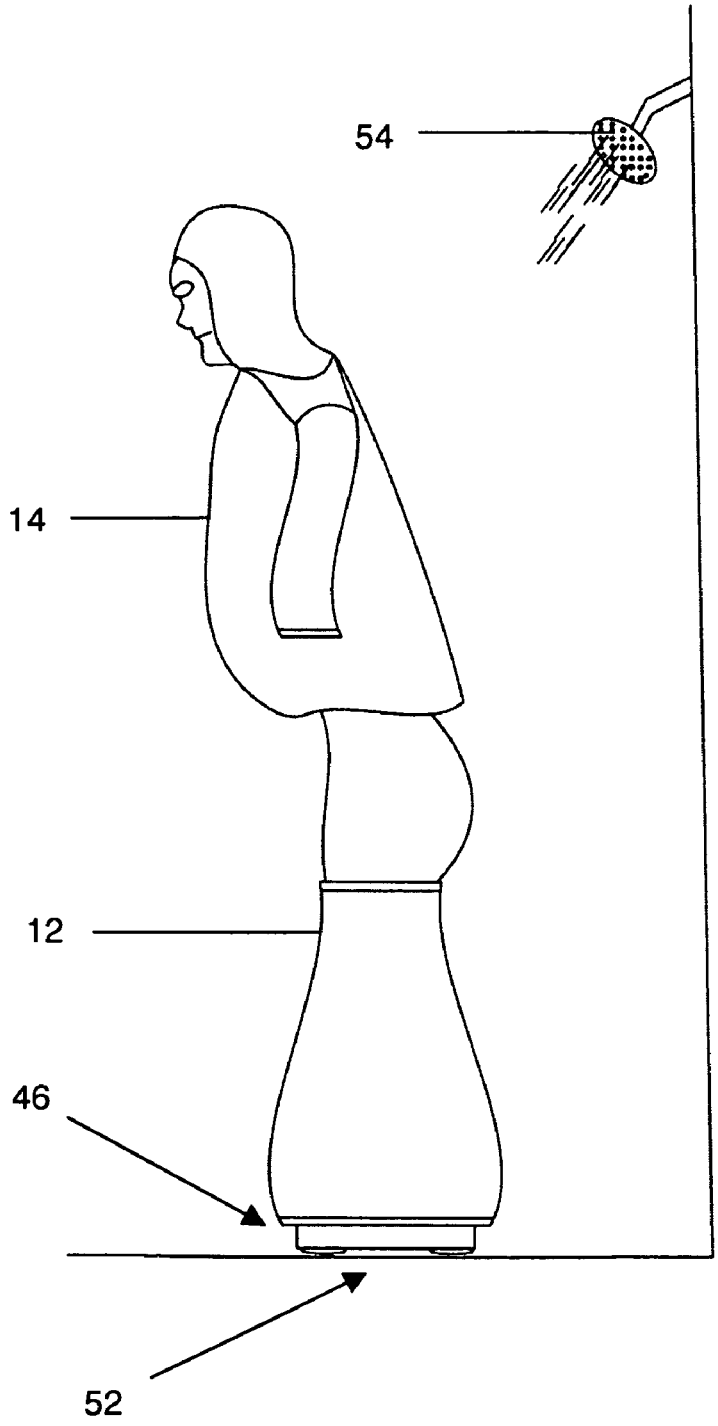
FIG. 9 of the drawings is a perspective view of a protective garment assembly in use in accordance with the present invention.

Referring now to FIGS. 8 and 9 collectively, protective garment 10 and associated accessories are shown. In operation, an individual preferably places optional base member 16 onto surface 52, which is typically the inside of a shower. Next, the individual preferably puts on lower garment 12 and engages lower garment securement member 24. The individual may preferably ensure that weighted hem 44 of lower garment 14 is positioned below top plate 48 of base 16. After securing the lower garment, the user next preferably puts on optional upper garment 14 and engages upper garment securement member 23. Following the securement of lower garment 12 (as well as optional upper garment 14), the individual preferably steps onto base 16. After stepping onto base 16, the individual then configures optional splash guard 38. If splash guard 38 has been fabricated into lower garment 12, the individual may preferably cover opening 39 by extending splash guard 38 over opening 39 and securing splash guard 38 to front 42. If splash guard 38 comprises a separate apparatus, once lower garment 12 is secured, the individual then positions splash guard 38 above opening 39 and between his/her legs.

Lastly, the individual may preferably utilize shower and/or (water, medicament, or disinfectant) source 54 to cleanse themselves while fully and/or partially clothed. The cleansing allows a user to remove unwanted material (e.g. feces, excrements) which may be difficult to remove during normal bathroom usage when, for example, an individual is stricken with hemorrhoids—or other medical abnormality which precludes the individual from normal sanitary cleansing.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A protective garment assembly for use while cleansing at least a portion of a user's body, comprising:

a lower garment, wherein the lower garment releasably covers the user's legs proximate and below the user's anal region to and including the user's feet while exposing the user's anal region;

wherein the lower garment comprises a flexible, substantially waterproof member which comprises:

an upper region, wherein the upper region comprises a lower garment securement member which enables substantially water-tight releasable securement of the lower garment to the user's legs proximate and below the user's anal region; and a lower region, wherein the lower region and the upper region are spaced apart from one another to define a lower garment length, and wherein the lower region covers the user's feet; and a base member which receives the user's feet wearing the lower garment, wherein the base member comprises: a bottom wall, a top wall, and at least one side wall which are spaced apart from one another to define a substantially polygonal cavity.

2. The protective garment assembly according to claim 1, wherein the lower region of the lower garment comprises a weighted hem.

3. The protective garment assembly according to claim 1, wherein the lower garment securement member further comprises a drawstring.

4. The protective garment according to claim 1, wherein the lower garment securement member comprises a loop of elastomeric material, which is secured about the upper region of the lower garment.

5. The protective garment according to claim 1, wherein the lower garment securement member further comprises:

a first strap, wherein the first strap comprises:

a first tab; and a second tab;

a second strap, wherein the second strap comprises:

a first tab; and a second tab;

wherein the first tab of the first strap and the first tab of the second strap are attached to at least a portion of the lower garment, and wherein the second tab of the first strap comprises a series of hooks, and the second tab of the second strap comprises a series of loops, and further wherein the second tab of the first strap and the second tab of the second strap cooperate and provide releasable securement of the lower garment to at least a portion of an associated individual.

6. The protective garment according to claim 1, wherein the lower garment further comprises a first end and a second end, wherein the at least a portion of the first end comprises a series of loops and at least a portion of the second end comprises a series of hooks, and wherein the first end and the second end cooperate and provide releasable securement of the lower garment around at least a portion of an associated individual.

7. The protective garment assembly according to claim 1, wherein the protective garment further comprises a splash guard.

8. The protective garment according to claim 7, wherein the splash guard comprises a sheet of flexible, substantially waterproof material, and wherein the splash guard comprises a first end and a second end, wherein the first end is fixedly attached to at least a portion of the lower garment and the second end is releasably associable with at least a portion of the lower garment.

9. The protective garment assembly according to claim 7, wherein the splash guard comprises a sheet of substantially waterproof material which is positioned above the upper region of the lower garment and between the user's legs.

10. The protective garment assembly according to claim 1, further comprising:

an upper garment, wherein the upper garment releasably covers at least a portion of the user's torso;

wherein the upper garment comprises a flexible, substantially waterproof member material which covers at least a portion of the user's torso; and an upper garment securement member which is associated with at least a portion of the upper garment.

11. The protective garment assembly according to claim 10, wherein the upper garment further comprises a hood, wherein the hood covers at least a portion of the user's head.

12. The protective garment assembly according to claim 10, wherein the upper garment further comprises a sleeve, wherein the sleeve receives at least a portion of the user's arm.

13. The protective garment assembly according to claim 1, wherein the top wall further comprises a surface region at least partially fabricated from a non-slip material.

14. The protective garment assembly according to claim 1, wherein the base member further comprises at least one ground engaging support member.

15. The protective garment assembly according to claim 1, wherein the lower region of the lower garment extends below the top wall of the base member.

16. A protective garment assembly for use while cleansing at least a portion of a user's body, comprising:

a lower garment, wherein the lower garment releasably covers the user's legs proximate and below the user's anal region to and including the user's feet while exposing the user's anal region, and wherein the lower garment comprises a flexible, substantially waterproof member which comprises: an upper region, wherein the upper region comprises a lower garment securement member which enables substantially water-tight releasable securement of the lower garment to the user's legs proximate and below the user's anal region; and a lower region, wherein the lower region and the upper region are spaced apart from one another to define a lower garment length, and wherein the lower region covers the user's feet;

a splash guard, wherein the splash guard comprises a sheet of substantially waterproof material which is positioned above the upper region of the lower garment and between the user's legs;

an upper garment, wherein the upper garment releasably covers at least a portion of the user's torso, and wherein the upper garment comprises a flexible, substantially waterproof member material which covers at least a portion of the user's torso, and an upper garment securement member which is associated with at least a portion of the upper garment; and a base member which receives the user's feet, wherein the base member comprises: a bottom wall, a top wall, and at least one side wall which are spaced apart from one another to define a substantially polygonal cavity.

17. A protective garment assembly for use while cleansing at least a portion of a user's body, consisting of:

a lower garment, wherein the lower garment releasably covers the user's legs proximate and below the user's anal region to and including the user's feet while exposing the user's anal region, and wherein the lower garment comprises a flexible, substantially waterproof member which comprises: an upper region, wherein the upper region comprises a lower garment securement member which enables substantially water-tight releasable securement of the lower garment to the user's legs proximate and below the user's anal region; and a lower region, wherein the lower region and the upper region are spaced apart from one another to define a lower garment length, and wherein the lower region covers the user's feet;

a splash guard, wherein the splash guard comprises a sheet of substantially waterproof material which is positioned above the upper region of the lower garment and between the user's legs;

an upper garment, wherein the upper garment releasably covers at least a portion of the user's torso, and wherein the upper garment comprises a flexible, substantially waterproof member material which covers at least a portion of the user's torso, and an upper garment securement member which is associated with at least a portion of the upper garment; and a base member which receives the user's feet, wherein the base member comprises: a bottom wall, a top wall, and at least one side wall which are spaced apart from one another to define a substantially polygonal cavity.

* * * * *